US011660490B2

(12) United States Patent
Bacchus

(10) Patent No.: US 11,660,490 B2
(45) Date of Patent: May 30, 2023

(54) EXERCISE APPARATUS AND METHOD OF USE

(71) Applicant: Lancelot G. Bacchus, Laurelton, NY (US)

(72) Inventor: Lancelot G. Bacchus, Laurelton, NY (US)

( * ) Notice: Subject to any disclaimer, the term of this patent is extended or adjusted under 35 U.S.C. 154(b) by 2 days.

(21) Appl. No.: 17/355,329

(22) Filed: Jun. 23, 2021

(65) Prior Publication Data

US 2022/0001229 A1 Jan. 6, 2022

Related U.S. Application Data

(60) Provisional application No. 63/048,234, filed on Jul. 6, 2020.

(51) Int. Cl.

| | |
|---|---|
| ***A63B 21/04*** | (2006.01) |
| ***A63B 21/00*** | (2006.01) |
| ***A63B 23/04*** | (2006.01) |
| ***A63B 23/035*** | (2006.01) |

(52) U.S. Cl.

CPC ..... *A63B 21/0442* (2013.01); *A63B 21/4034* (2015.10); *A63B 21/4035* (2015.10); *A63B 23/03541* (2013.01); *A63B 23/0482* (2013.01); *A63B 2210/50* (2013.01); *A63B 2225/09* (2013.01)

(58) Field of Classification Search

CPC ..... A63B 21/0442; A63B 21/4034; A63B 21/4035; A63B 23/03541; A63B 23/0482; A63B 2210/50; A63B 2225/09; A63B 21/0552; A63B 21/0557; A63B 21/4033

See application file for complete search history.

(56) References Cited

U.S. PATENT DOCUMENTS

| | | | | |
|---|---|---|---|---|
| 8,403,818 | B1 * | 3/2013 | Wilkinson | F16G 11/106 482/121 |
| 9,776,035 | B2 * | 10/2017 | Nouri | A63B 23/0482 |
| 9,901,502 | B2 * | 2/2018 | Rosario, Jr. | A61H 37/00 |
| 10,493,314 | B1 * | 12/2019 | Lujan | A63B 21/0557 |
| 11,135,465 | B1 * | 10/2021 | Melendez | A63B 21/0442 |
| 2006/0194679 | A1 * | 8/2006 | Hatcher | A63B 21/0552 482/121 |
| 2011/0218084 | A1 * | 9/2011 | Doherty | A63B 21/0557 482/122 |
| 2012/0329619 | A1 * | 12/2012 | Goldberg | A63B 21/0442 482/142 |
| 2016/0263420 | A1 * | 9/2016 | DuMee | A63B 21/4043 |

* cited by examiner

*Primary Examiner* — Andrew S Lo
(74) *Attorney, Agent, or Firm* — Neil D. Gershon

(57) ABSTRACT

An exercise apparatus having an upper body portion and a lower body portion, the upper and lower body portions positionable in a substantially horizontal position to accommodate a user in a kneeling position. A connector connects the upper and lower body portions. First and second resistant members are attached to the one or both of the upper and lower body portions. The body portions can be movable between a closed folded position and an open position.

20 Claims, 8 Drawing Sheets

EXERCISE APPARATUS AND METHOD OF USE

BACKGROUND OF THE INVENTION

This application claims priority from provisional application No. 63/048,234, filed Jul. 6, 2020, the entire contents of which are incorporated herein by reference.

1. Field of the Invention

The present invention is directed to exercise equipment, and more particularly, to a portable, collapsible exercise apparatus and corresponding methods of use.

2. Background of the Related Art

Exercise equipment is often bulky and cumbersome to move. This means that a user needs to find a site containing the exercise equipment. It would be advantageous to provide an exercise apparatus that is transportable by the user so that exercise is not limited to stationary on site equipment.

SUMMMARY OF THE INVENTION

The present invention overcomes the problems and deficiencies of the prior art. The present invention addresses the shortcoming of bulky and cumbersome exercise equipment by providing a lightweight exercise apparatus that is collapsible and easily portable. The exercise apparatus of the present invention can be used for butt toning exercise e.g., for the gluteus maximus, as well as for other exercises. By being easily transportable, the user can carry the exercise equipment with them and not need to rely on access to a site, e.g., a gym, containing the equipment. Additionally, not all gyms contain the necessary exercise equipment, so the portability of the present invention ensures that the user has the desired exercise apparatus available.

The apparatus is designed for working the gluteus maximus with the user in a kneeling position. However, it additionally or alternatively can be used for exercise/training of other muscles such as the shoulders, biceps, triceps, etc. For these muscles, the apparatus can be used in a standing position or lying on one's side with the apparatus remaining in the horizontal (flat) position.

In accordance with one aspect of the present invention, an exercise apparatus is provided comprising an upper body portion and a lower body portion, the upper and lower body portions positionable in a substantially horizontal position to accommodate a user. A connector connects the upper and lower body portions. First and second resistance members are attached to one or both of the upper and lower body portions.

In some embodiments, a distance between the upper and lower body portions is adjustable to accommodate users of different heights.

In some embodiments, the first and second resistance members are movable by the left and right foot of the user for butt toning exercise.

In some embodiments, the upper body portion has first and second handles for gripping by the user.

In some embodiments, the first and second resistance members are attached to the upper body portion to apply a first tension and second and third resistant members are attached to the lower body portion to apply a second tension. In some embodiments, the third and fourth resistance members have a length less than the length of the first and second resistance members. The resistance members can be attached to various regions of the upper and lower body portions. The resistance members can be in the form of elastic stretchable bands.

In some embodiments, an upper surface of the lower body portion and/or upper body portion includes one or more cushions for the knees or elbows of the user.

In some embodiments, the first and second resistance members are removably attached to the apparatus.

In some embodiments, first and second foot blocks are provided extending from the lower body portion to receive the left and right foot, respectively of the user.

In some embodiments, non-slip members are positioned on the lower surface of the lower body portion.

In some embodiments, the apparatus is foldable to a closed position wherein the upper and lower body portions face each other. In some embodiments, the upper and lower body portions are hingedly connected and foldable to move the apparatus to a closed position for transport.

In accordance with another aspect of the present invention, a portable and foldable butt toning exercise apparatus is provided comprising an upper body portion and a lower body portion, the upper and lower body portions positionable in a horizontal position to accommodate a user in a prone-like kneeling position. A connector connects the upper and lower body portions. First and second resistance members are attached to one or both of the upper and lower body portions, the first resistance member having a first foot holder to receive a left foot of the user and the second resistance member having a second foot holder to receive the right foot of the user, wherein tension is applied to the first and second resistance members by the left and right foot of the user, respectively.

In some embodiments, a distance between the upper and lower body portions is adjustable to accommodate users of different heights.

In some embodiments, the upper body portion has first and second handles for gripping by the user. In some embodiments, one or both of an upper surface of the lower body portion and an upper surface of the body portion includes one or more cushions.

In some embodiments, the first and second resistance members are removably attached to the apparatus and replaceable with resistance members of a different tension.

In some embodiments, the upper and lower body portions are movable to a folded closed position wherein the upper and lower body portions face each other for portability of the apparatus.

BRIEF DESCRIPTION OF THE DRAWINGS

So that those having ordinary skill in the art to which the subject invention appertains will more readily understand how to practice the methodologies described herein, various embodiments thereof will be described in detail hereinbelow with reference to the drawings, wherein.

DETAILED DESCRIPTION

Figure 1:
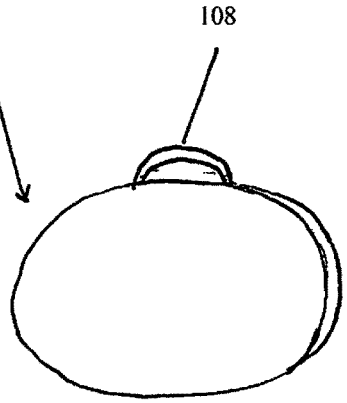
FIG. 1 is a side plan view of an exercise apparatus according to one embodiment of the present invention shown in a closed (collapsed, folded) configuration.

Referring now to the drawings wherein like reference numerals identify similar structures, element, and features, various embodiments of the presently disclosed exercise apparatus will be discussed.

The exercise apparatus of the present invention provides a lightweight portable device. The apparatus is foldable to case carrying size so it can easily be transported by the user. Several embodiments of the exercise apparatus are illustrated in the drawings and described below. Note the apparatus can be used for butt toning (gluteus maximus) exercises, but is not limited to butt toning exercises as it can also be used for other exercises for other parts of the user's body, e.g., shoulders, triceps, biceps, etc.

Figure 2:
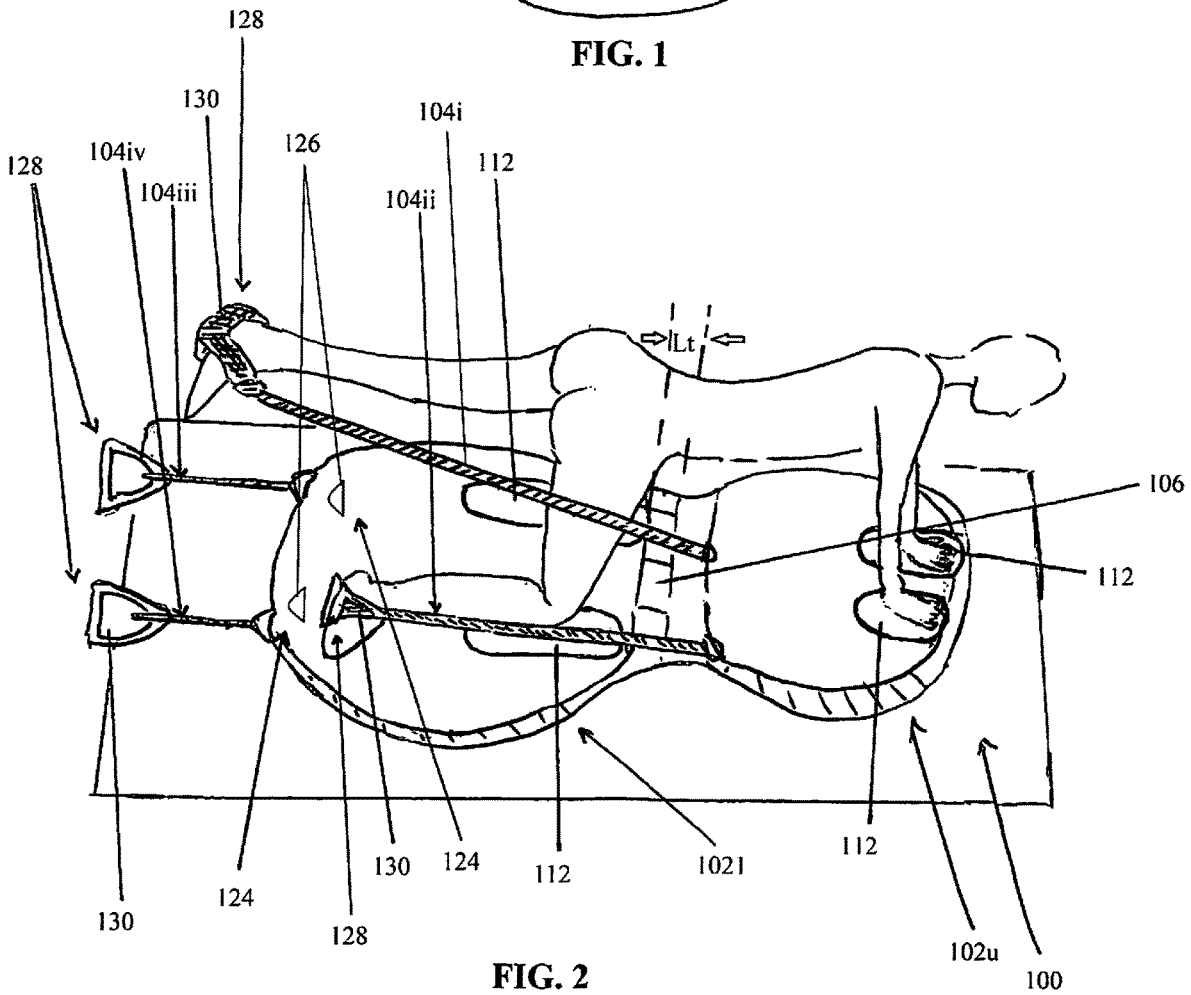
FIG. 2 is a top perspective view of the exercise apparatus of FIG. 1 and shown in use in an open (expanded, unfolded) configuration for positioning along the floor, the user shown in the kneeling position.
Figure 3:
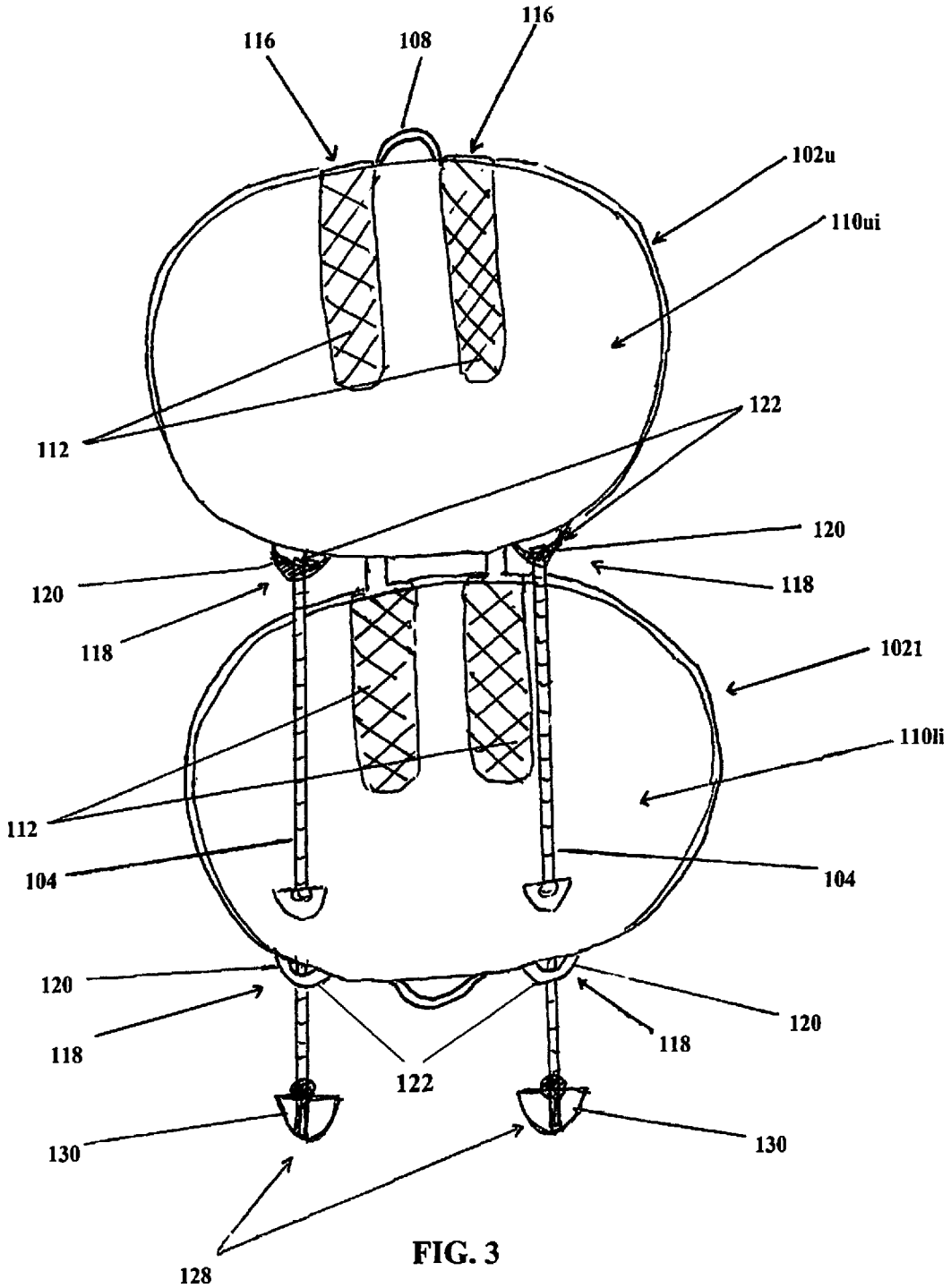
FIG. 3 is a top plan view of the exercise apparatus of FIG. 1 shown in the open configuration.
Figure 4:
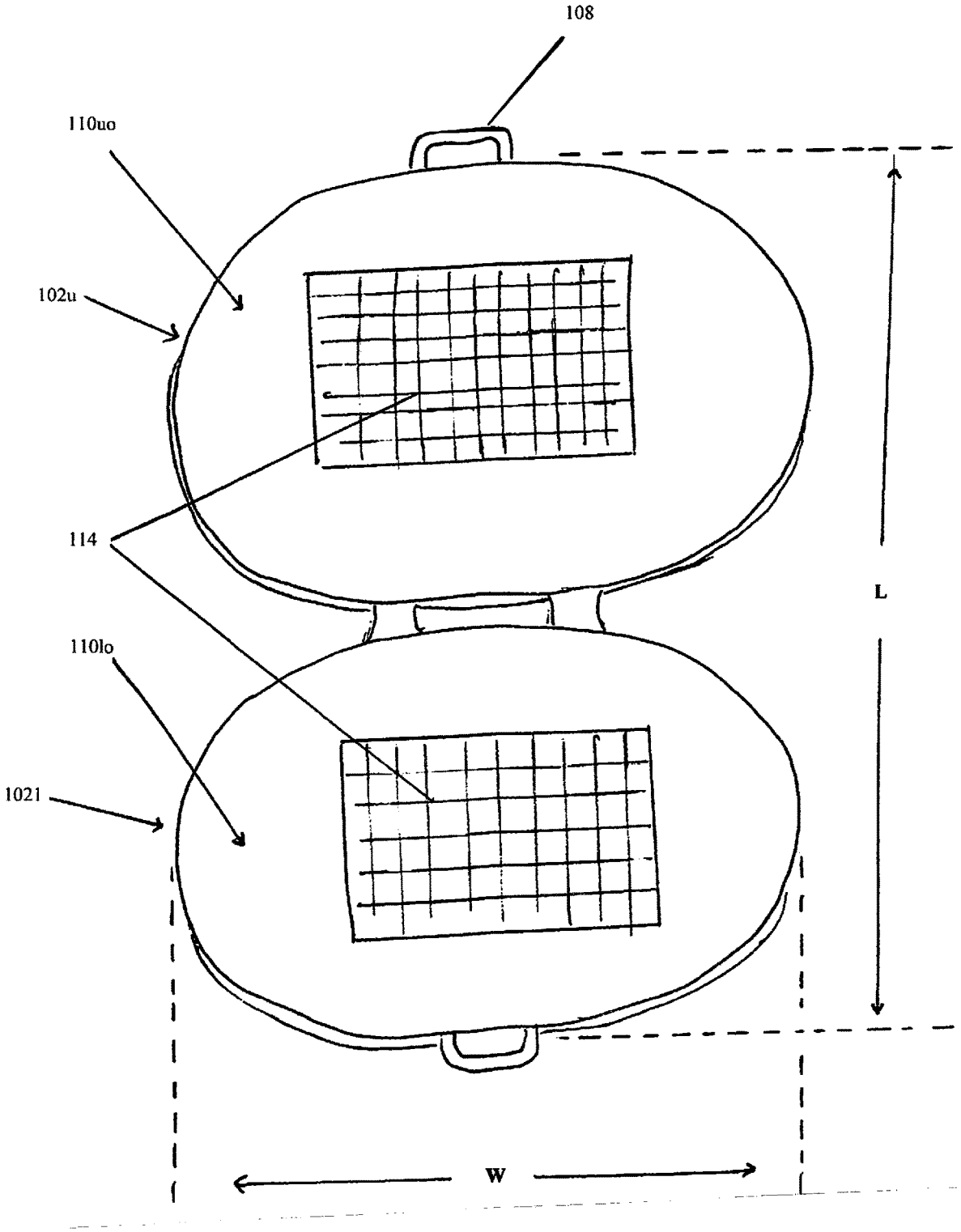
FIG. 4 is a bottom plan view of the exercise apparatus of FIG. 1 shown in the open configuration.

Turning first to FIGS. 1-4, these Figures illustrate one embodiment of the exercise apparatus of the present invention, which is identified generally by the reference character 100. The apparatus 100 includes an upper (head) body portion 102*u*, a lower (leg, foot) body portion 102*l*, and one or more resistance (training) members 104. The body portions 102*u*, 102*l* are connected to each other such that the apparatus 100 is reconfigurable between a closed configuration (also referred to herein as a first, collapsed, or folded configuration) as shown in FIG. 1, which facilitates transport and/or storage of the apparatus 100, and an open configuration (also referred to herein as a second, expanded, or unfolded configuration) as shown in FIGS. 2-4, which allows for use of the apparatus 100. In the open position, the apparatus 10 (and upper and lower body portions) are placed in a substantially horizontal position. Substantially horizontal refers to a position on the floor or other supporting surface which can be parallel to the floor (flat on the floor) or slightly inclined with respect to the floor. In this manner, the user is kneeling on the apparatus over the upper surfaces of the upper and lower body portions. This horizontal position should be differentiated from a vertical position which is parallel to a wall (transverse to the floor).

In the particular embodiment of the disclosure seen in FIGS. 1-4, in the open configuration, it is envisioned that the apparatus 100 may define an overall length L (FIG. 4) that lies substantially within the range of approximately 2' (feet) to approximately 4' (feet), and in more preferred embodiments, approximately 3', and an overall width W that lies substantially within the range of approximately 1.5' (feet) to approximately 4' (feet), and in preferred embodiments, approximately 2'. It should be appreciated, however, that larger and smaller widths and lengths of the apparatus 100 would be within the scope of the present invention. Also, different shapes of the body portions are disclosed which can be symmetrical or asymmetrical.

In the particular embodiment of the disclosure seen in FIGS. 1-4, the apparatus 100 includes one or more tethers 106, e.g., one or more straps, living hinges, etc., (FIG. 2) that extend between and connect the body portions 102*u*, 102*l*. In such embodiments, it is envisioned that the tether(s) 106 may be integrally (e.g., monolithically) formed with the body portion 102*u* and/or the body portion 102*l* or, alternatively, that the tether(s) 106 may be separate component(s) of the apparatus 100. To increase versatility of the apparatus 100, it is envisioned that the tether(s) 106 may be configured so as to define an adjustable length Lt (FIG. 2) to allow the spacing between the body portions 102*u*, 102*l* to be varied when the apparatus 100 is in the open configuration, thus allowing for use by a wider range of user (e.g., taller and shorter individuals) and increasing user comfort. For example, it is envisioned that the tether(s) 106 may include a ratcheting mechanism, strap with spaced loops, adjustable screws, or any other such suitable components and/or structures/mechanisms that enables length adjustment. In this manner, the distance between body portions 102*u* and 102*l* can be increased or decreased to adjust for the height of the user, e.g., for taller individuals the mechanism would be adjusted so that the spacing between body portions 102*u*, 102*l* increases and for shorter individuals the mechanism would be adjusted so that the spacing between body portions 102*u*, 102*l* would be decreased. Alternatively, it is envisioned that in alternate embodiments, the tether(s) 106 may be configured such that the length between the body portions 102*u*, 102*l* is fixed.

In alternate embodiments, the tether(s) 106 may be omitted and the body portions 102*u*, 102*l* may be connected to each other via a hinge member (e.g., one or more pivot pins, rods, etc.) that extends into (through) the body portions 102*u*, 102*l*. In these embodiments, the distance between the body portions 102*u*, 102*l* would not be adjustable, although in certain embodiments, they can be directly attached with a distance adjustable feature.

To improve portability of the apparatus 100, in some embodiments, either or both of the body portions 102*u*, 102*l* may include a handle 108 (FIGS. 1, 3, 4) and one or more lightweight materials may be utilized in construction of the body portions 102*u*, 1021. For example, it is envisioned that the body portions 102*u*, 102*l* may include (e.g., may be formed partially or entirely from) one or more non-metallic materials (e.g., plastic(s), polymers, carbon fiber, etc.) and/or one or more metallic materials (e.g., aluminum, steel, etc.). In the particular embodiment of the disclosure seen in FIGS. 1-4, the apparatus 100 includes material(s) of construction that are selected such that an overall weight of the apparatus 100 lies within the range of approximately 3 lbs. to approximately 7 lbs. (e.g., approximately 5 lbs.). It should be appreciated, however, that lighter and heavier embodiments of the apparatus 100 would be within the scope of the present disclosure (e.g., to increase durability, strength, etc.). It is also envisioned that the apparatus 100 may be formed through any suitable method of manufacture, such as, for example, injection molding, stamping, casting, 3-D printing, etc. Different shaped handles to facilitate carrying of the apparatus are also contemplated, and the handles can be attached to various regions of the body portions.

The body portion 102*u* includes an inner (top or upper) surface 110*ui* (FIG. 3) that faces the user in the open position of the apparatus and an outer (bottom or lower) surface 110*uo* (FIG. 4) that faces the floor in the open in-use position. It is envisioned that the inner surface 110*ui* may be either (generally) planar (flat) in configuration or that the inner surface 110*ui* may be non-planar in configuration. For example, the inner surface 110*ui* may include an overall curvature. The inner surface 110*ui* may include one or more recessed regions to accommodate the user's arms (hands, elbows, forearms) during use of the apparatus 100. To increase user comfort, the upper body portion 102*u* may include one or more cushioning members 112 (e.g., pads), as shown in FIGS. 2 and 3, that are positioned to support the user's arms (hands, elbows, forearms). While the cushioning member(s) 112 are shown as including a generally elongated (e.g., generally rectangular or generally elliptical) configuration in the particular embodiment of the apparatus 100 seen in FIGS. 1-4, it should be appreciated that the size and configuration of the cushioning member(s) 112 may be varied in alternate embodiments without departing from the scope of the present invention, as discussed below.

To maintain proper positioning and/or increase stability of the apparatus 100 during use, the outer surfaces 110*uo*, 110*lo* of the respective body portions 102*u*, 102*l* may include one or more non-slip (friction) members 114 (e.g., rubberized pad(s)) (FIG. 4) to increase friction with the surface supporting the apparatus 100 (e.g., the floor). Additionally, or alternatively, the outer surfaces 110*uo*, 110*lo* of the respective body portions 102*u*, 102*l* may include texturing (e.g., dimpling) to further improve stability of the apparatus 100 during use. The non-slip members for both body portions can be of varying sizes and configurations and one or multiple non-slip members can be provided.

Thus, as used herein, the inner (top/upper) surface of the body portions refers to the surface facing the user and the outer (bottom/lower) surface of the body portions refers to the surface facing the floor.

To improve user control and/or comfort during use of the apparatus 100, the body portion 102*u* may include one or more gripping portions (members) 116 (FIG. 3). In certain embodiments, the gripping portion(s) 116 may be integrally (e.g., monolithically) formed with the body portion 102*u*. For example, the gripping portion(s) 116 may include contoured sections of the body portion 102*u* that are configured to receive (or otherwise accommodate) the user's hands and/or fingers. Additionally, or alternatively, the gripping portion(s) 116 may include one or more fixed or removable handle members (e.g., bars, etc.), as discussed in further detail below. In such embodiments, the gripping portion(s) 116 may be adjustable to increase versatility of the apparatus 100 and/or user comfort, e.g., movable with respect to the body portion 102*u* to increase its distance from the outer edge of the body portion 102*u*. To further increase user comfort, the gripping portion(s) 116 may in some embodiments include padding or other such cushioning material(s).

In the illustrated embodiment, to connect the resistance members to the body portion 102*u*, the body portion 102*u* includes one or more engagement members 118 (FIG. 3). The resistance members 104 are in some embodiments releasably engageable (connectable) to the engagement members 18. More specifically, in the particular embodiment shown in FIGS. 1-4, the body portion 102*u* includes a pair of eyelets 120 (or other such members) extending from its upper surface 110*ui* that are configured for connection of corresponding engagement structure 122 (e.g., hooks) on the resistance member(s) 104. In alternate embodiments of the disclosure, however, the engagement member(s) 118 may be omitted from the body portion 102*u* and the resistance members 104 non-removably connected to the body portion 102*u*. The resistance members 104 in alternate embodiments can be non-removably connected to the engagement members. In the embodiments wherein the resistance members 104 are releasably connected to the upper body portion 102*u*, e.g., via a hook/eyelet structure, resistance members having a greater or lesser degrees of resistance can be utilized to accommodate the specific user. For example, for increased resistance, resistance members 104 of less resistance can be removed and replaced by resistance members having greater resistance and vice versa. The resistance members 104 can be in the form of elastic stretchable bands or other tensioning members.

The lower body portion 102*l* includes an inner (top or upper) surface 110*li* (FIG. 3) and an outer (bottom or lower) surface 110*lo* (FIG. 4). As with the body portion 102*u*, the inner surface 110*li* may be either (generally) planar (flat) in configuration or the inner surface 110*li* may be non-planar in configuration. For example, the inner surface 110*li* may include an overall curvature and/or the inner surface 110*li* may include one or more recessed regions to accommodate the user's legs (knees, shins) during use of the apparatus 100. To increase user comfort, the body portion 102*l* may include one or more cushioning members 112 (e.g., pads), as shown in FIGS. 2 and 3, that are positioned to support the user's legs (knees, shins). The configuration and number of cushioning members 112 in the upper and lower body portions 110*u* and 110*l* can vary from that shown.

As discussed in connection with the body portion 102*u*, the outer surface 110*lo* of the body portion 102*l*, as shown in the embodiment of FIG. 4, may include one or more non-slip (friction) members 114 (e.g., a rubberized pad) to increase friction with the surface supporting the apparatus 100 (e.g., the floor) and, thus, maintain proper positioning and/or increase stability of the apparatus 100 during use. Additionally, or alternatively, the outer surface 110*lo* of the body portion 102*l* may include texturing (e.g., dimpling) to further improve stability of the apparatus 100 during use.

In the illustrated embodiment, the body portion 102*l* further includes one or more engagement members 118 (FIG. 3) that are configured for releasable connection of the resistance member(s) 104. More specifically, in the particular embodiment shown in FIGS. 1-4, the body portion 102*l* includes a pair of eyelets 120 (or other such members) that are configured to receive the corresponding engagement structure 122 (e.g., hooks) on the resistance member(s) 104. Alternatively, the eyelets can be on the resistance members 104 and the engagement structure, e.g., hooks, on the body portion 102*l* and/or body portion 102*u*). Other types of engagement/attachment structure are also contemplated. In alternate embodiments of the disclosure, the engagement member(s) 118 may be omitted from the body portion 102*l*. As such, embodiments of the apparatus 100 are envisioned in which the resistance member(s) 104 are connectable to each of the body portions 102*u*, 102*l*, as are embodiments in which the resistance member(s) 104 are connectable to either the body portion 102*u* or the body portion 102*l*.

To increase user stability, it is envisioned that the body portion 102*l* may also include one or more rests 124 (FIG. 2) that are configured to support the user during use of the apparatus. In the particular embodiment of the apparatus 100 seen in FIGS. 1-4, for example, the body portion 102*l* includes a pair of foot blocks 126 each configured to receive a foot of the user. It is also envisioned that the body portion 102*u* may include one or more similar blocks that are configured to support the user's arms (e.g., elbows). The rests 124 project upwardly from the surface of the body portion 102*l*, and can include in some embodiments a cup shape for the user's heel or other configurations to accommodate other portion of the user's foot, to facilitate the user's positioning of the user's body on the upper and lower body portions 102*u*, 102*l* of the apparatus 100. As shown, the foot rests are separate from the resistance members.

In various embodiments, it is envisioned that the rest(s) 124 may be either fixedly (e.g., integrally) connected to the body portion 102*l* or that the rest(s) 124 may be non-fixedly (e.g., movably) connected to the body portion 1021. For example, the rest(s) 124 may be repositionable between a variety of locations, e.g., repositionable along the length of the body portion 102*l*, to allow for use by a wider range of user (e.g., taller and shorter individuals) and/or repositionable along the width of the body portion 102*l*. In certain embodiments, the rests 124 can be removable from the body portion 102*l*.

With continued reference to FIGS. 1-4, the resistance member(s) 104 will be discussed. Each resistance member 104 includes a tactile or body engagement portion 128 (e.g., a foot-loop 130, a handle, etc.) (FIGS. 2, 3) that allows the user to securely interact with the resistance member(s) 104 and the apparatus 100. For example, in the method of use illustrated in FIG. 2, the user interacts with the resistance member(s) 104 by placing her/his foot into an opening defined by the foot loop 130. It should be appreciated, however, that the specific configuration of the tactile portion 128 may be altered or varied in alternate embodiments of the disclosure to allow for various interactions by the user such that a variety of exercises can be performed using the apparatus 100.

In the particular embodiment illustrated in FIGS. 1-4, the apparatus 100 is illustrated as including four resistance members 104*i*-104*iv* (FIG. 2) that are configured to offer resistance that lies substantially within the range of approximately 5 lbs. to approximately 100 lbs. however, other ranges are also within the scope of the present disclosure. A fewer or greater number of resistance members are also contemplated.

The resistance members 104 may be either identical or non-identical. For example, the resistance members 104 may be configured to provide different resistances to increase the versatility of the apparatus 100 and the spectrum of available training. In such embodiments, the apparatus 100 may, thus, be provided as a kit that includes a series of different resistance members 104 (e.g., one or more of the resistance members 104*i*, one or more of the resistance members 104*ii*, one or more of the resistance members 104*iii*, one or more of the resistance members 104*iv*, etc.) which can be of different lengths, widths, tensions, etc.

Referring still to FIGS. 1-4, a method of using the apparatus 100 will be discussed. The apparatus can be used as a butt toner, i.e., for gluteus maximus training, although as discussed herein, other uses are also contemplated. Initially, the apparatus 100 is moved from the closed configuration (FIG. 1) to the open configuration (FIGS. 2-4) such that the respective outer surfaces 110*uo*, 110*lo* of the body portions 102*u*, 102*l* (and the non-slip members 114) are in suitable contact with the surface supporting the apparatus 100 (e.g., the floor) so the user can use the apparatus in a bent kneeling or prone-like position, e.g., facing the floor as shown in FIG. 2. Once opened, in the embodiments having releasably connectable resistance members, the select resistance member(s) 104 can be connected to the body portion 102*u* and/or to the body portion 102*l* by connecting the engagement structure(s) 122, e.g., a hook, on the resistance member(s) 104 to the engagement member(s) 118 (e.g., the eyelet(s) 120) on the body portion 102*u* and/or the body portion 1021. For example, when the apparatus 100 is utilized in the manner illustrated in FIG. 2 (e.g., to exercise the user's legs and gluteus maximus), the user may elect to connect the resistance member(s) 104 to the body portion 102*u* or to the body portion 102*l* based on the desired level of resistance. For any given resistance member 104, it is envisioned that the resistance offered may be increased via connection to the body portion 102*u* and decreased via connection to the body portion 102*l* due to the resultant relative increase or decrease in the range of motion determined by the point of connection. More specifically, in the context of FIG. 2, by connecting the resistance member(s) 104 to the body portion 102*u*, the range of motion and the resistance offered can be increased when compared to the range of motion and the resistance offered by connecting the resistance member(s) 104 to the body portion 102*l*.

Following connection of the resistance member(s) 104 to the body portion 102*u* and/or the body portion 102*l*, the user can position herself/himself on the apparatus 100 as desired, preferably in the kneeling position facing downward toward the floor utilizing the knee cushions of the lower body portion 102*u* and hand/elbow/forearm cushions of the upper body portion 102*l*. As noted above, the user can also lie on the user's side to perform other exercises or stand or kneel with the back upright (facing the wall) to perform other exercises for different body muscles. Thus, depending upon the particular exercise being performed, the user may utilize the cushioning members 112 to increase the comfort of the user's arms and/or legs.

After completion of the exercise regimen, the resistance member(s) 104 can be disconnected (removed) from the body portion 102*u* and/or the body portion 102*l* and the apparatus 100 can be moved from the open configuration (FIGS. 2-4) to the closed configuration (FIG. 1) and stored for later use. As shown in FIG. 1, the closed configuration of the apparatus 100 provides a lightweight portable exercise apparatus.

Figure 5:
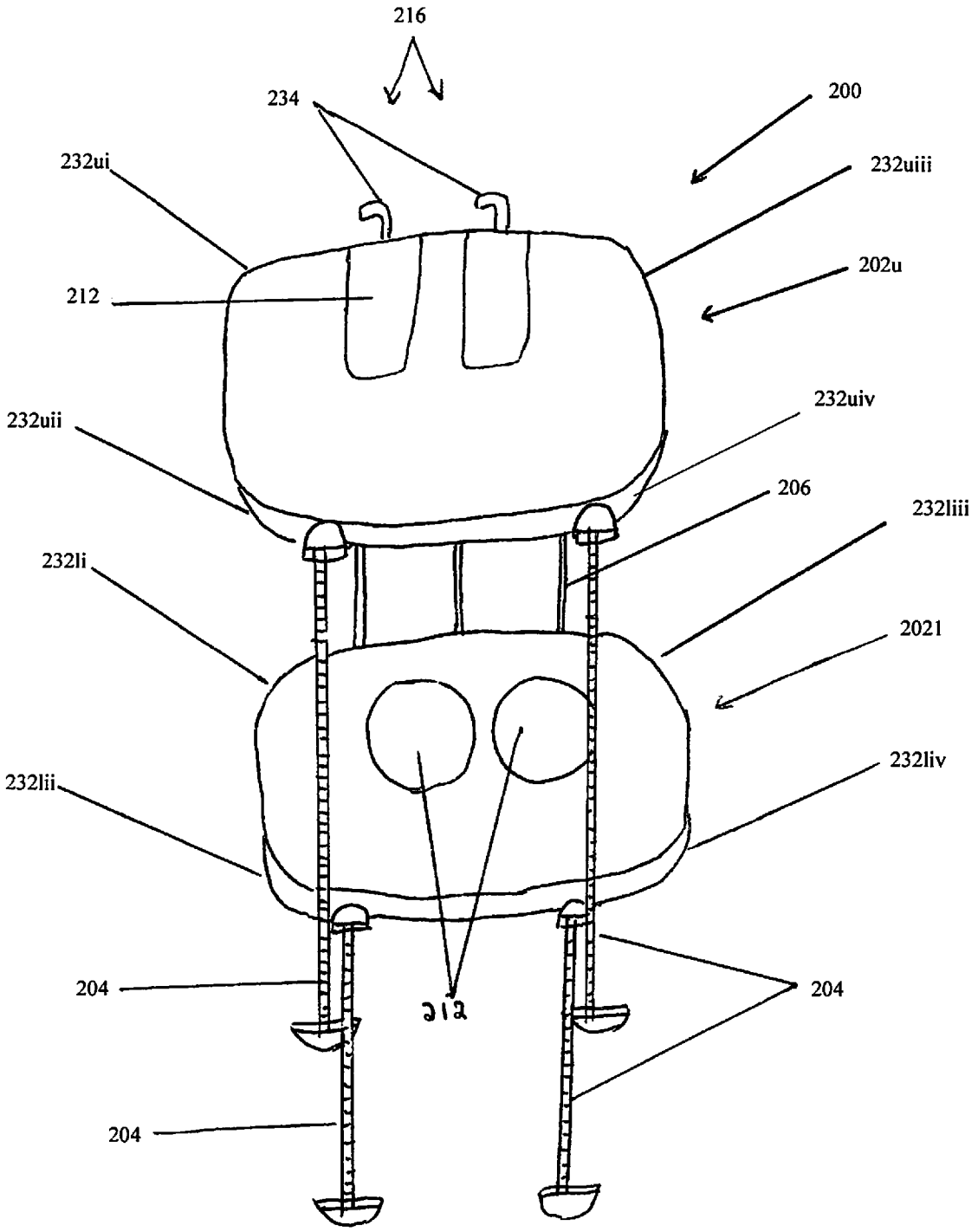
FIG. 5 is a top plan view of an alternate embodiment of the exercise apparatus of the present invention shown in an open (expanded, unfolded) configuration.
Figure 6:
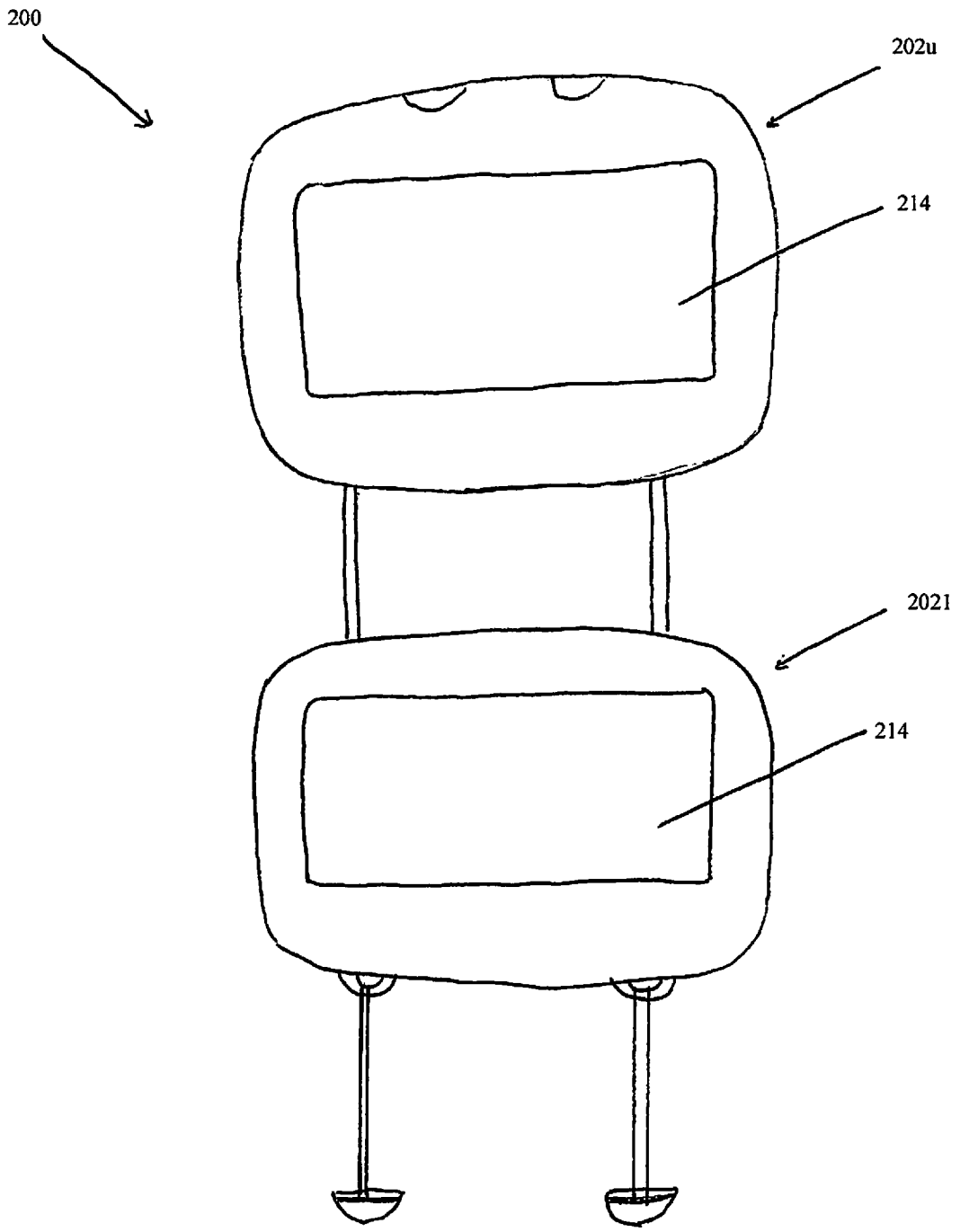
FIG. 6 is a bottom plan view of the exercise apparatus of FIG. 5.
Figure 7:
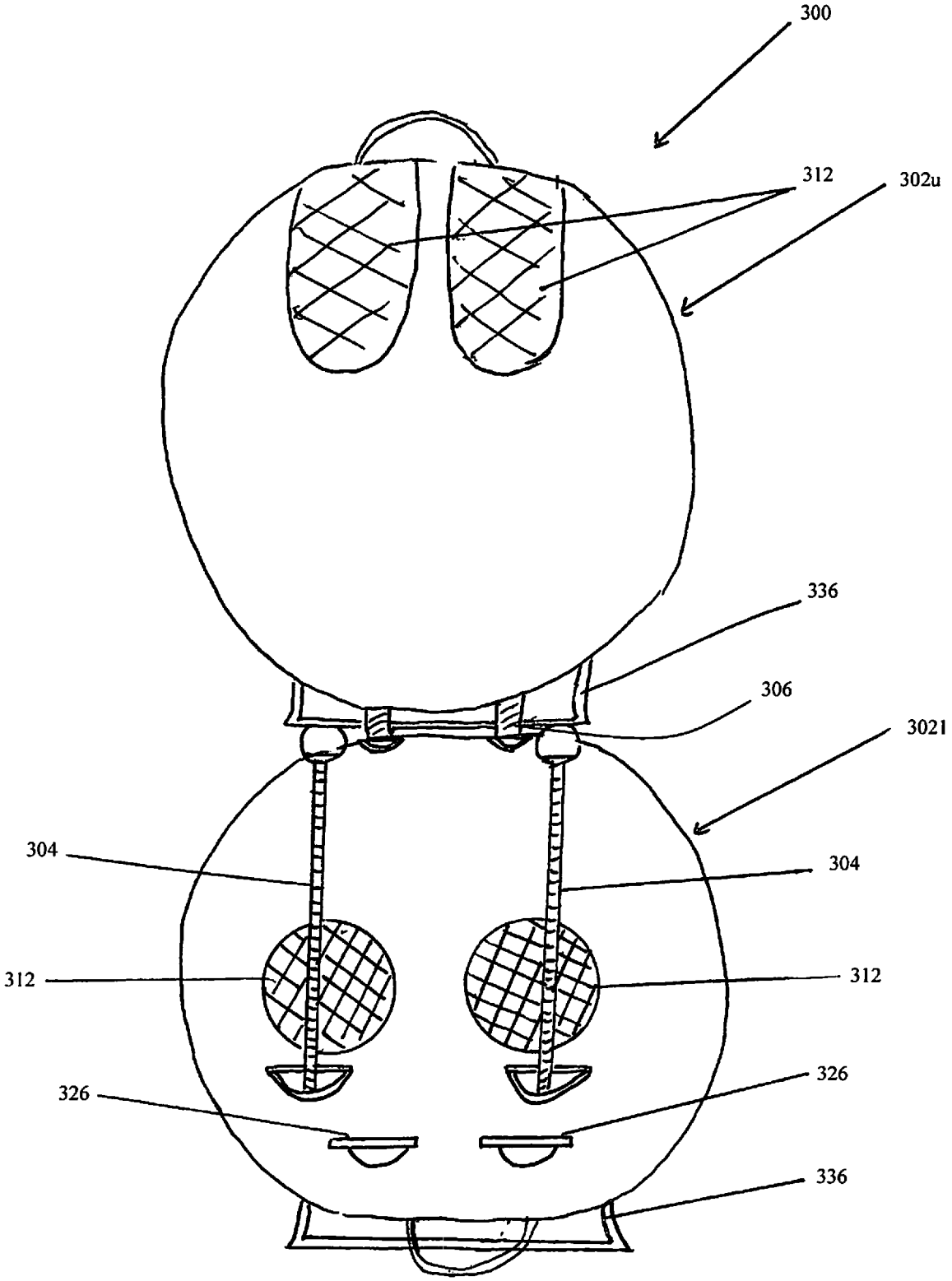
FIG. 7 is a top plan view of an alternate embodiment of the exercise apparatus of the present invention shown in an open (expanded, unfolded) configuration.
Figure 8:
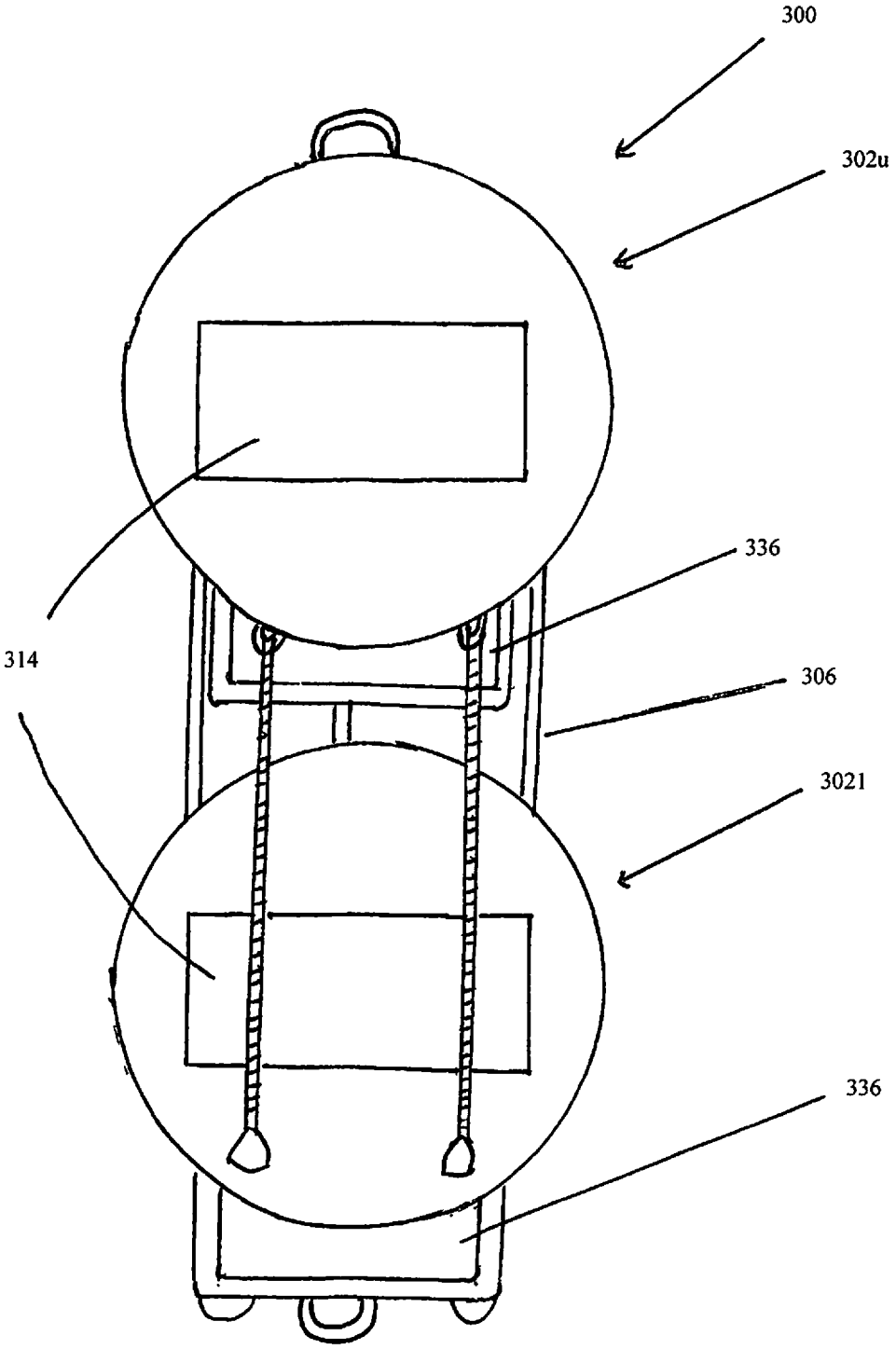
FIG. 8 is a bottom plan view of the exercise apparatus of FIG. 7.
Figure 9:
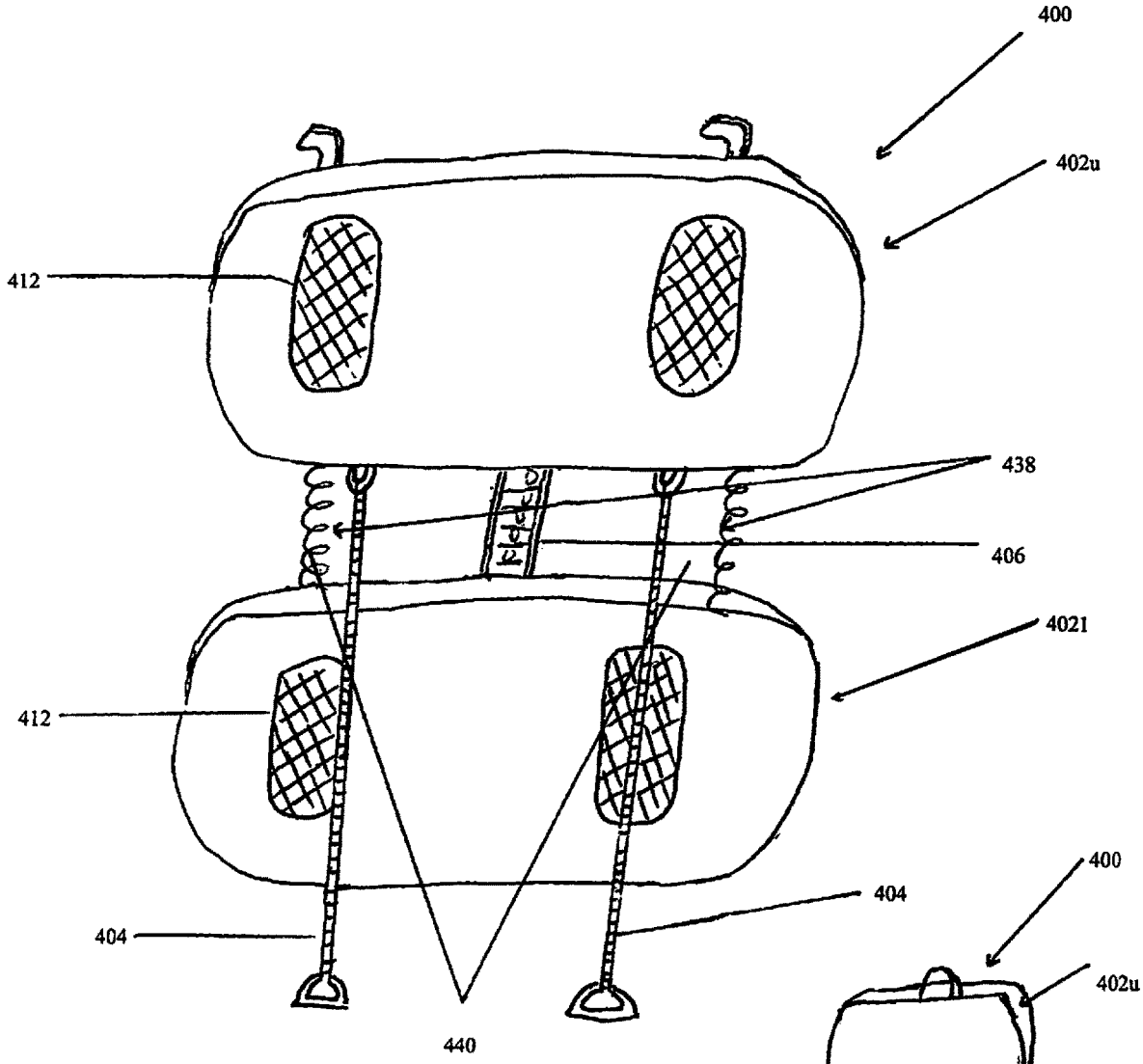
FIG. 9 is a top perspective view of an alternate embodiment of the exercise apparatus of the present invention shown in an open (expanded, unfolded) configuration.
Figure 10:
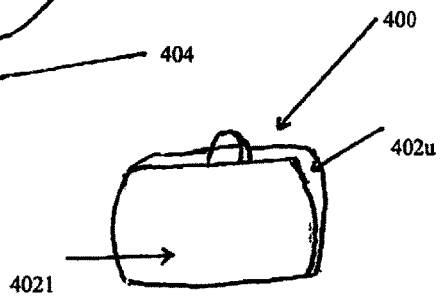
FIG. 10 is a side perspective view of the exercise apparatus of FIG. 9 shown in a closed (collapsed, folded) configuration.

With reference now to FIGS. 5-10, various alternate embodiments of the apparatus 100 will be discussed. More specifically, FIGS. 5 and 6 illustrate an embodiment of the apparatus that is identified generally by the reference character 200, FIGS. 7 and 8 illustrate an embodiment of the apparatus that is identified generally by the reference character 300, and FIGS. 9 and 10 illustrate an embodiment of the apparatus that is identified generally by the reference character 400. Each apparatus 200, 300, 400 is substantially similar to the apparatus 100 discussed above with respect to FIGS. 1-4 and, accordingly, will only be discussed with respect to any difference(s) therefrom in the interest of brevity. Thus, the discussion herein of the function and features of apparatus 100 of FIGS. 1-4 and the alternate versions are fully applicable to each apparatus of FIGS. 5-10.

In contrast to the generally ovate (elliptical) configuration of the apparatus 100 seen in FIGS. 1-4, the apparatus 200 of FIG. 5 includes a generally rectangular configuration with radiused corner portions. More specifically, the apparatus 200 includes an upper body portion 202*u* with radiused corner portions 232*ui*, 232*uii*, 232*uiii* and 232*uiv* and a lower body portion 202*l* with radiused corner portions 232*li*, 232*lii*, 232*liii* and 232-232*liv*.

The upper body portion 202*u* includes gripping portions(s) 216 that are configured as handle members 234, which may be either fixedly (e.g., integrally) or non-fixedly (e.g., movably) connected to the body potion 202*u*. As mentioned above, in certain embodiments, the handle members 234 may be adjustable to increase versatility of the apparatus 200 and/or user comfort. The lower body portion

2021 includes cushioning members 212 (e.g., pads) that are generally circular in configuration, rather than elongated, as seen in FIG. 3 and in upper body portion 202*u*, for example. In this embodiment, the upper and lower body portions 202*l* and 202*u* are attached, e.g., tethered, by connectors 206 a fixed distance, however, alternatively, they can be adjustable to adjust the distance between the upper and lower body portions 202*u*, 202*l*, as discussed above with regard to apparatus 100. Several connectors 206 can be provided, or alternatively a single in this embodiment and in the other embodiments disclosed herein.

To maintain proper positioning and/or increase stability of the apparatus 200 during use, as discussed in connection with the apparatus 100 (FIGS. 1-4), it is envisioned that each of the body portions 202*u*, 202*l* may include one or more non-slip (friction) members 214 (e.g., rubberized pad(s)) (FIG. 6) on its bottom surface to increase friction with the surface supporting the apparatus 200 (e.g., the floor). The resistance members are designated by reference numeral 204 and are configured to function like resistance members 104*i*-104*iv* and can be connected to the body portions in the ways described herein.

Referring now to FIGS. 7 and 8, the apparatus 300 includes a generally circular configuration. The apparatus 300 includes body portions 302*u*, 302*l* that each includes support bars 336 (or other such members). The connectors 306 connect the body portions 302*u*, 302*l* and in some embodiments can be adjustable to adjust the distance between the body portions 302*u*, 302*l*. In some embodiments, the connector 306 can be connected to the support bar 306. The pads are designated by reference numeral 312, the foot blocks are designated by reference numeral 326, non-slip (friction) members (e.g., rubberized pad(s)) to increase friction are designated by reference numeral 314 and the resistance members are designated by reference numeral 304 and are configured to function like resistance members 104*i*-104*iv*. Two resistance members 304 can be provided by way of example as shown, however, additional resistance members could also be provided. The resistance members can be attached to the support bar or attached to the upper body portions.

Referring now to FIGS. 9 and 10, the apparatus 400 includes respective upper and lower body portions 402*u*, 402*l* as well as one or more biasing members 438 that extend therebetween (e.g., to generally maintain spacing between the body portions 402*u*, 402*l* when the apparatus 400 is in the open configuration, assist with opening and/or closure of the apparatus 400, etc.). In the illustrated embodiment, for example, the biasing member(s) 438 are configured as coil springs. It should be appreciated, however, that the particular configuration of the biasing member(s) 438 may be varied in alternate embodiments without departing from the scope of the present invention. The upper and lower body portions 402*u*, 402*l* can be a fixed distance or in alternate embodiments adjustable at connector(s) 406. The connector(s) 406 can be in the form of a ratchet to allow for adjustability or can be in the forms as explained above. The pads are designated by reference numeral 412 and the resistance members are designated by reference numeral 404 and are configured to function like resistance members 104*i*-104*iv*. Two resistance members 404 are shown by way of example, although more resistance members could be provided. Handle members for gripping by the user, similar to handle members 234 of FIG. 5 are shown.

FIG. 10 shows apparatus 400 folded/collapsed to a compact portable configuration.

Although the apparatus and methods of the subject invention have been described with respect to preferred embodiments, which constitute non-limiting examples, those skilled in the art will readily appreciate that changes and modifications may be made thereto without departing from the spirit and scope of the present invention as defined by the appended claims.

Additionally, persons skilled in the art will understand that the elements and features shown or described in connection with one embodiment may be combined with those of another embodiment without departing from the scope of the present invention and will appreciate further features and advantages of the presently disclosed subject matter based on the description provided.

Throughout the present invention, terms such as "approximately," "generally," "substantially," and the like should be understood to allow for variations in any numerical range or concept with which they are associated. For example, it is intended that the use of terms such as "approximately" and "generally" should be understood to encompass variations on the order of 25%, or to allow for manufacturing tolerances and/or deviations in design.

Although terms such as "first," "second," "third," etc., may be used herein to describe various operations, elements, components, regions, and/or sections, these operations, elements, components, regions, and/or sections should not be limited by the use of these terms in that these terms are used to distinguish one operation, element, component, region, or section from another. Thus, unless expressly stated otherwise, a first operation, element, component, region, or section could be termed a second operation, element, component, region, or section without departing from the scope of the present disclosure.

Each and every claim is incorporated as further disclosure into the specification and represents embodiments of the present disclosure. Also, the phrases "at least one of A, B, and C" and "A and/or B and/or C" should each be interpreted to include only A, only B, only C, or any combination of A, B, and C.

What is claimed is:

1. A portable butt toning exercise apparatus comprising:

an upper body portion and a lower body portion, the upper and lower body portions movable from a closed folded position to an open position positionable in a horizontal position to accommodate a user, the lower body portion having a periphery and an inner surface defined within the periphery;

a connector connecting the upper and lower body portions;

first and second engagement members; and first and second resistance members attached to one or both of the upper and lower body portions and movable by feet of the user in a kneeling position and configured for butt toning exercise;

the first and second resistance members attached to the first and second engagement members, the first and second engagement members coupled to the upper body portion and extending in a direction towards the lower body portion;

wherein the first and second resistance members extend towards the lower body portion and overlie the inner surface of the lower body portion along a length thereof.

2. The apparatus of claim 1, wherein the connector comprises a length adjustment mechanism, the length adjustment mechanism is adjustable to adjust a distance between the upper and lower body portions to accommodate users of different heights.

3. The apparatus of claim 1, wherein the first and second resistance members are movable by the left and right foot of the user for butt toning exercise.

4. The apparatus of claim 1, wherein the upper body portion and the lower body portion each have a handle for gripping by the user, the handles spaced from the resistance members and the handles are aligned along an axis extending through a central portion of the upper and lower body portion.

5. The apparatus of claim 1, wherein first and second resistance members are attached to the upper body portion to apply a first tension and second and third resistant members are attached to the lower body portion to apply a second tension.

6. The apparatus of claim 5, wherein the third and fourth resistance members have a length less than the length of the first and second resistance members.

7. The apparatus of claim 1, wherein an inner surface of the lower body portion includes a) a pair of cushions located inwardly of the first and second resistance members to accommodate the legs of the user and b) a pair of elongated cushioning members on the upper body portion to support arms of the user, the cushions and cushioning members each having a length exceeding a width.

8. The apparats of claim 1, wherein the first and second resistance members are removably attached to the apparatus.

9. The apparatus of claim 1, wherein the first resistance members has a foot loop configured to receive the left foot and the second resistance member has a foot loop configured to receive the right foot, the apparatus further comprising first and second foot blocks extending from the lower body portion to receive the left and right foot, respectively, of the user, the first and second foot blocks spaced from the resistance members and projecting upwardly from an upper surface of the lower body portion.

10. The apparatus of claim 1, further comprising non-slip members positioned on the lower surface of one or both of the lower body portion and upper body portion.

11. The apparatus of claim 1, wherein the apparatus is foldable to the closed position wherein an upper surface of the upper and lower body portions face each other.

12. The apparatus of claim 1, wherein the upper and lower body portions are hingedly connected and foldable to move the apparatus to the closed position for transport wherein an upper surface of the upper and lower body portions face each other.

13. A portable exercise apparatus comprising:

an upper body portion and a lower body portion, the upper and lower body portions movable from a closed folded position to an open position positionable in a horizontal position to accommodate a user;

a connector connecting the upper body portion and the lower body portion, wherein the upper and lower body portions contain a biasing spring positioned between the upper and lower body portions; and first and second resistance members attached to one or both of the upper and lower body portions.

14. A portable and foldable butt toning exercise apparatus comprising:

an upper body portion and a lower body portion, the upper and lower body portions positionable in a horizontal position to accommodate a user in a kneeling position facing the upper body portion, the upper and lower body portions each having a periphery and an inner surface defined within the periphery;

the lower body portion having a pair of spaced apart recessed regions on an inner surface configured to accommodate knees of the user during the butt toning exercise; and an adjustable connector connecting the upper and lower body portions; and first and second resistance members attached to the one or both of the upper and lower body portions, the first resistance member having a first foot holder configured to receive a left foot of the user and the second resistance member having a second foot holder configured to receive a right foot of the user, wherein tension is applied to the first and second resistance members by the left and right foot of the user, respectively, for butt toning of the user.

15. The apparatus of claim 14, wherein the adjustable connector comprises a length adjustment mechanism, the length adjustment mechanism is adjustable to adjust a distance between the upper and lower body portions is adjustable to accommodate users of different heights.

16. The apparatus of claim 14, wherein the upper body portion has first and second handles, the handles spaced from the resistance members and the first and second handles are aligned along an axis extending through a central portion of the upper and lower body portion.

17. The apparatus of claim 14, wherein the inner surface of the upper body portion includes a pair of recessed regions to accommodate the arms of the user longitudinally aligned with the recessed regions on the lower body portion.

18. The apparatus of claim 14, wherein the first and second resistance members are removably attached to the apparatus and replaceable with other resistance members.

19. The apparatus of claim 14, wherein the upper and lower body portions are movable to a folded closed position wherein an upper surface of the upper and lower body portions face each other for portability of the apparatus.

20. The apparatus of claim 17, wherein the recessed regions of the upper and lower portions have a length exceeding a width.

* * * * *